US010955219B1

(12) United States Patent
Morris

(10) Patent No.: US 10,955,219 B1
(45) Date of Patent: Mar. 23, 2021

(54) HANDGUN SIGHT PUSHER

(71) Applicant: Revo Brand Group, LLC, Plymouth, MN (US)

(72) Inventor: Matthew C. Morris, Minneapolis, MN (US)

(73) Assignee: New Revo Brand Group, LLC, Plymouth, MN (US)

( * ) Notice: Subject to any disclaimer, the term of this patent is extended or adjusted under 35 U.S.C. 154(b) by 0 days.

(21) Appl. No.: 16/836,970

(22) Filed: Apr. 1, 2020

(51) Int. Cl.
*F41G 1/26* (2006.01)
*F41G 1/54* (2006.01)

(52) U.S. Cl.
CPC ..... *F41G 1/26* (2013.01); *F41G 1/545* (2013.01)

(58) Field of Classification Search
CPC ..... F41G 1/545; F41G 1/26
See application file for complete search history.

(56) References Cited

U.S. PATENT DOCUMENTS 2,599,839 A * 6/1952 Keifer, Jr. ..... F41G 1/26 42/139
4,669,193 A 6/1987 Moore
D335,805 S 5/1993 Ransom
5,864,957 A 2/1999 Small
8,316,573 B2 11/2012 Bietsch
8,397,422 B2 3/2013 Bietsch
8,707,609 B2 4/2014 Fisher
8,910,413 B2 12/2014 Hillwig, Jr.
9,464,870 B2 10/2016 Gomez
9,593,910 B1 3/2017 Fisher
9,784,535 B1 10/2017 Cheng et al.
9,869,529 B2 1/2018 Gomez

OTHER PUBLICATIONS

Armorer's Handgun Sight Tool. Website. Retrieved Mar. 2020. https://www.wheelertools.com/gunsmithing-tools/sight-adjustment-tools/armorers-handgun-sight-tool/710905.html.
MGW Rear Sight Tool Glock. Website. Retrieved Jun. 2020. https://www.midwayusa.com/product/1007109821.
Universal Rear Sight Tool. Website. Retrieved Jun. 2020. https://www.ncstar.com/optics-acc/tools/handgun-tools/vtuprs-univ-rear-sight-adjust-tool.
Universal Sight Pusher Tool for Handguns. Website. Retrieved Jun. 2020. https://www.amazon.com/Universal-Sight-Pusher-Tool-Handguns/dp/B075QV1SQY.

* cited by examiner

*Primary Examiner* — Reginald S Tillman, Jr.
(74) *Attorney, Agent, or Firm* — Grumbles Law PLLC; Brittany Nanzig

(57) ABSTRACT

A handgun sight pusher can include an upper frame having a screw drive within an internal adjustment cavity and a pusher block having pusher flanges that is rotatably engaged with the screw drive; and a lower frame connected to the upper frame and having a gun slide channel for receiving a gun slide and a plurality of side clamps for securing the gun slide in the gun slide channel. The internal adjustment cavity can include a transitory space and a rotation space. Rotation of the screw drive can cause the pusher block to move along the screw drive and transition between the transitory space and the rotation space. The pusher block can retain its orientation in the transitory space and rotate freely within the rotation space.

18 Claims, 8 Drawing Sheets

HANDGUN SIGHT PUSHER

FIELD OF THE INVENTION

This disclosure relates to firearm maintenance aids, and more particularly, relates to tools for adjusting gun sights on a pistol slide.

BACKGROUND OF THE INVENTION

Gun sights are used on firearms to aid in aiming the firearm, and proper aim is critical to ensure an accurate shot is taken. A standard handgun sight includes a single raised projection centered at the top, front surface of the gun slide and a rear sight that is an elongate projection with a central notch at the rear of the slide. To aim the gun, the target is aligned with the front sight and the front sight is aligned within the notch of the rear sight.

If the gun is not properly sighted, the user's aim will be inaccurate. Further, individuals may desire a different type of sight and may therefore need to replace the sight that is currently on their gun. Therefore, there are times when a gun sight will need to be adjusted or replaced, and a device is needed that can facilitate these activities.

SUMMARY

This disclosure relates to firearm maintenance aids, and more particularly, relates to tools for adjusting gun sights on a pistol slide. In one aspect, the disclosure provides a handgun sight pusher that can include an upper frame having a screw drive within an internal adjustment cavity and a pusher block rotatably engaged with the screw drive; and a lower frame connected to the upper frame and having a gun slide channel for receiving a gun slide and a plurality of side clamps for securing the gun slide in the gun slide channel. The internal adjustment cavity can include a transitory space and a rotation space.

In some embodiments, rotation of the screw drive can cause the pusher block to move along the screw drive. Further, movement of the pusher block along the screw drive can transition the pusher block between the transitory space and the rotation space. The internal adjustment cavity can be structured and configured such that the pusher block can retain its orientation in the transitory space and rotate freely within the rotation space. In some cases, the pusher block can include two pusher flanges on a top of the pusher block that are separated by a bridge as well as two pusher flanges on a bottom of the pusher block that are separated by the bridge.

In some embodiments, at least one each of the plurality of side clamps can be located on either side of the gun slide channel and may be in horizontal alignment with each other. In some embodiments, the gun slide channel can include a bottom channel gap. And in some embodiments, the upper frame can further include a vertical hold down for clamping the gun slide between the vertical hold down and the gun slide channel of the lower frame.

In some embodiments, the lower frame can connect to the upper frame by frame bolts positioned to flank the gun slide channel. More specifically, the upper frame and the lower frame can have aligned vertical bores through which the frame bolts penetrate, and the frame bolts can be threadedly connected to the threaded vertical bores of the lower frame. In addition, the vertical bores can each additionally house a spring.

In some embodiments, the upper frame can include at least one horizontal bore through which the screw drive penetrates, and the screw drive can protrude out horizontally from the upper frame and through the horizontal bore. More specifically, an exterior end of the screw drive can be attached to a hand crank that can be used to rotate the screw drive. Further, the screw drive, the pusher block, and the hand crank can all rotate around a first axis. Some embodiments of the hand crank can include a socket drive.

In another aspect, the disclosure provides a handgun sight pusher that can include an upper frame having a screw drive within an internal adjustment cavity and a pusher block rotatable engaged with the screw drive, wherein rotation of the screw drive can cause the pusher block to move along the screw drive. The internal adjustment cavity can include a transitory space and a rotation space, and movement of the pusher block along the screw drive can transition the pusher block between the transitory space and the rotation space. The pusher block can retain its orientation in the transitory space and rotate freely within the rotation space. Further, the pusher block can include two pusher flanges on a top of the pusher block that are separated by a bridge. The handgun sight pusher can also include a lower frame connected to the upper frame and having a gun slide channel for receiving a gun slide, and a plurality of side clamps for securing the gun slide in the gun slide channel.

In another aspect, the disclosure provides a method for adjusting a handgun sight of a gun slide, the method including the steps of rotating a screw drive in a first direction until a pusher block that is rotatably engaged with the screw drive moves from a transitory space into a rotation space; rotating the screw drive in the first direction until the pusher block freely rotates 180 degrees in the rotation space; rotating the screw drive in a second, opposite direction until the pusher block that is rotatably engaged with the screw drive moves from the rotation space to the transitory space such that the pusher block is now 180 degrees rotated from its starting position; rotating the screw drive in the first or the second direction until the pusher block makes contact with a sight of a gun slide; and continuing to rotate the screw drive until the sight is moved into a predetermined position.

In some embodiments, the method can further include the steps of positioning a gun slide in a gun slide channel; and securing the gun slide in the gun slide channel using a plurality of side clamps, wherein the sight is aligned with the pusher block when the gun slide is secured in the gun slide channel. Further, the method can include the step of vertically securing the gun slide in the gun slide channel using a vertical hold down to clamp the gun slide between the vertical hold down and the lower frame.

The above summary is not intended to describe each and every example or every implementation of the disclosure. The description that follows more particularly exemplifies various illustrative embodiments.

BRIEF DESCRIPTION OF THE DRAWINGS

The following description should be read with reference to the drawings. The drawings, which are not necessarily to scale, depict examples and are not intended to limit the scope of the disclosure. The disclosure may be more completely understood in consideration of the following description with respect to various examples in connection with the accompanying drawings, in which.

DETAILED DESCRIPTION

Figure 1:
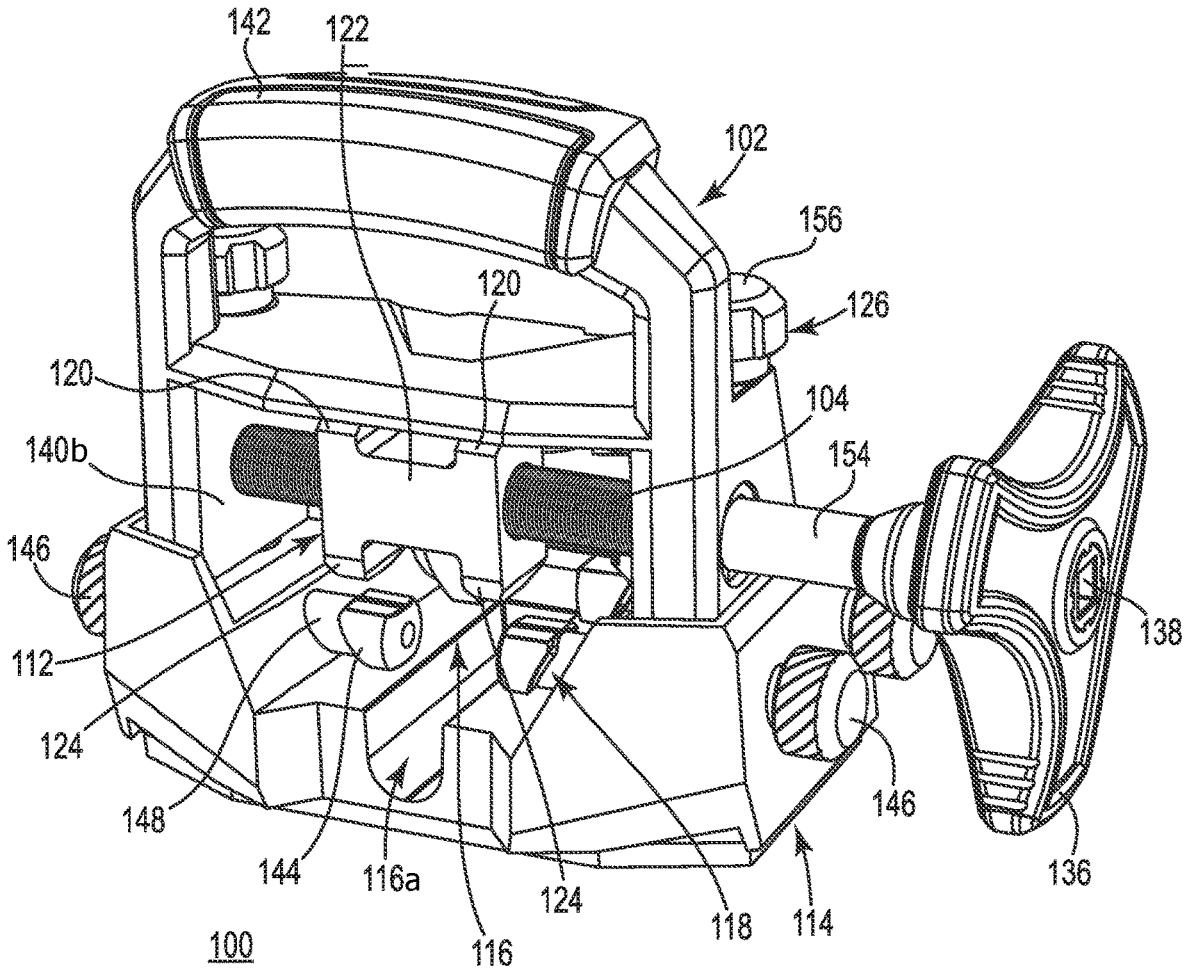
FIG. 1 is a front perspective view of an illustrative example of a handgun sight pusher of the present disclosure.

The present disclosure relates to firearm maintenance aids, and more particularly, relates to tools for adjusting gun sights on a pistol slide. Various embodiments are described in detail with reference to the drawings, in which like reference numerals may be used to represent like parts and assemblies throughout the several views. Reference to various embodiments does not limit the scope of the systems and methods disclosed herein. Examples of construction, dimensions, and materials may be illustrated for the various elements, those skilled in the art will recognize that many of the examples provided have suitable alternatives that may be utilized. Any examples set forth in this specification are not intended to be limiting and merely set forth some of the many possible embodiments for the systems and methods. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

Figure 3:
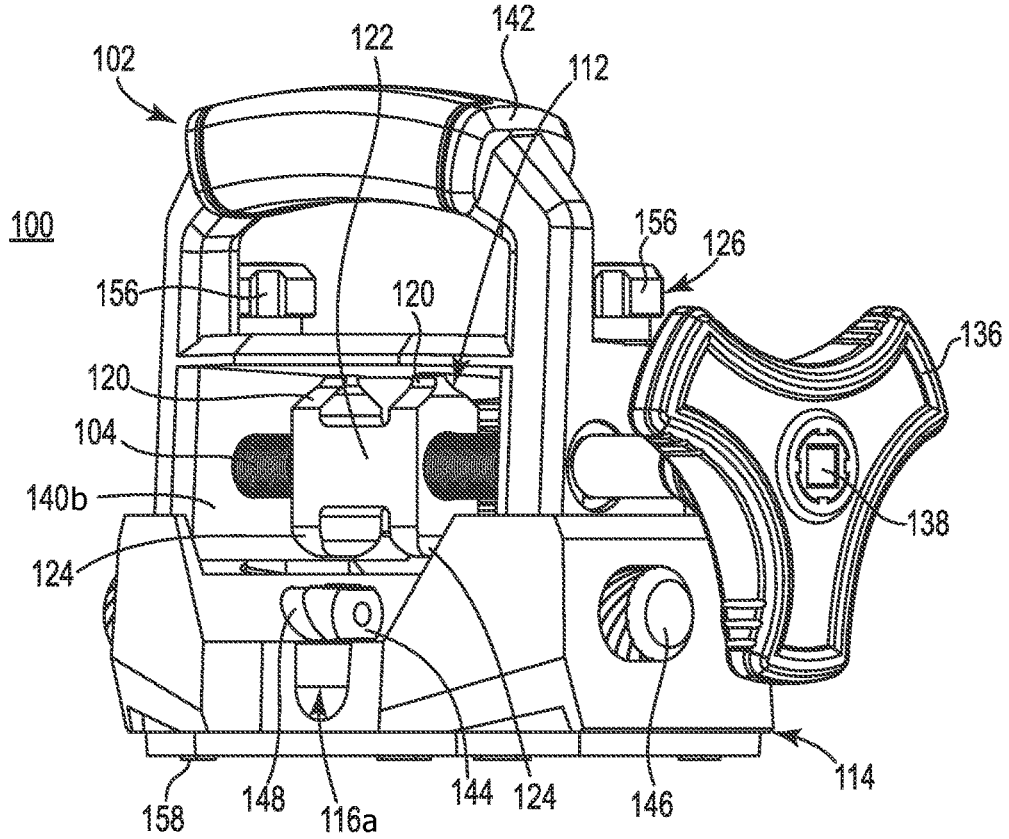
FIG. 3 is a perspective view of the handgun sight pusher of FIG. 1 with a pusher block in a transitory space of an internal adjustment cavity.
Figure 4:
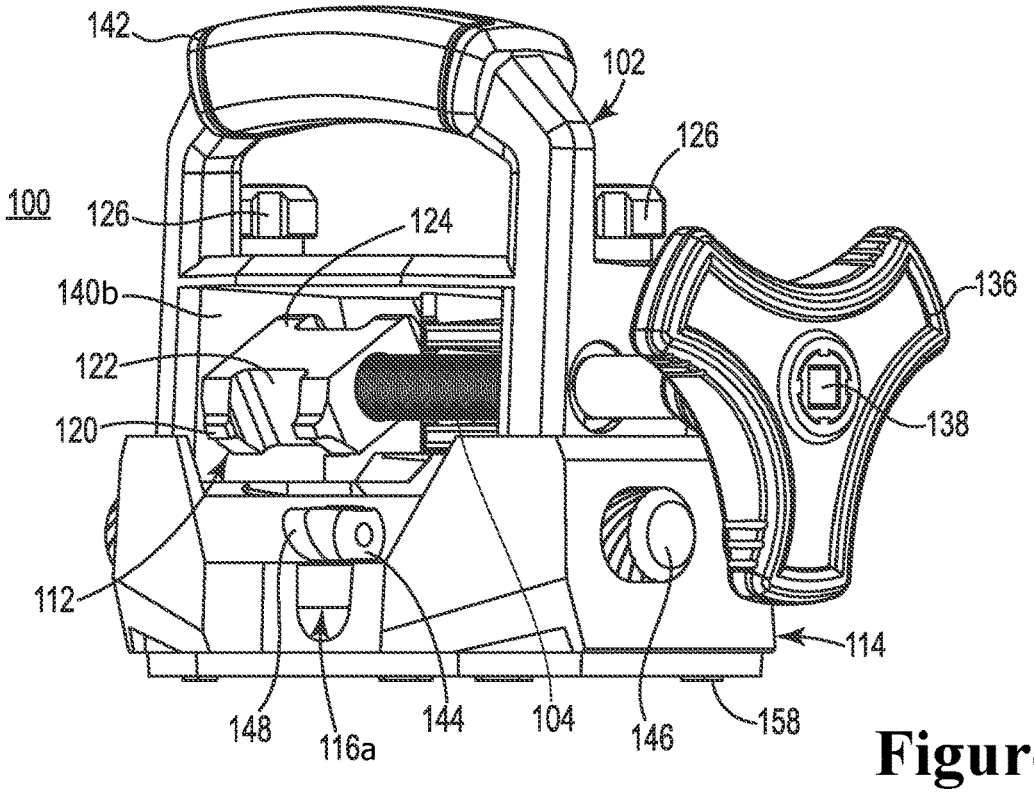
FIG. 4 is a perspective view of the handgun sight pusher of FIG. 1 with the pusher block in a rotation space of the internal adjustment cavity.
Figure 5:
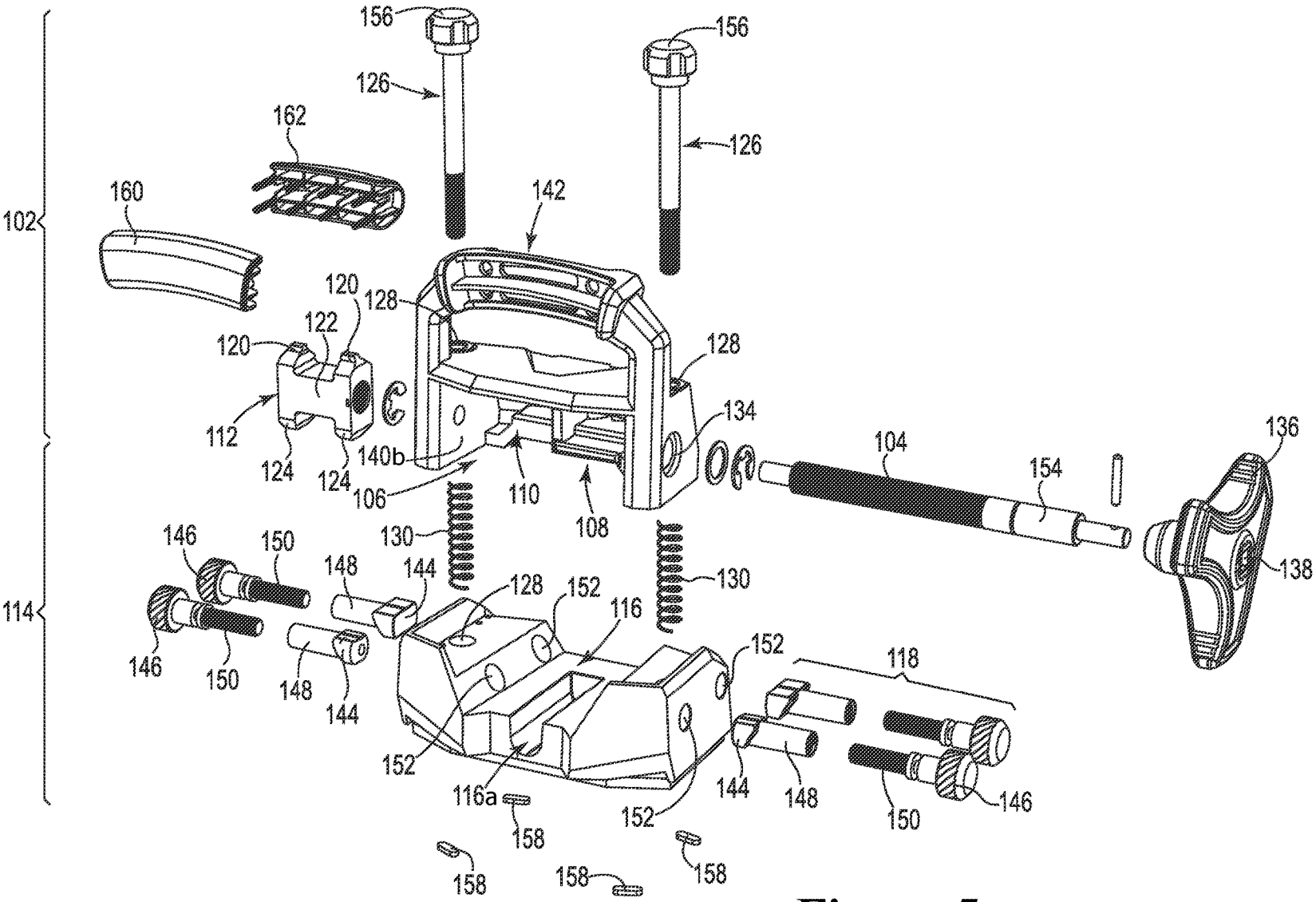
FIG. 5 is an exploded view of the handgun sight pusher of FIG. 1.

FIG. 1 is a front perspective view of an illustrative example of a handgun sight pusher. Handgun sight pusher 100 includes upper frame 102 and lower frame 114. Upper frame 102 can include screw drive 104 located within internal adjustment cavity 106, as illustrated in FIG. 5, which can include transitory space 108 and rotation space 100. Upper frame 102 can also include pusher block 112, which can be rotatably engaged with screw drive 104, as illustrated in FIGS. 3-5. Lower frame 114 can be connected to upper frame 102 and can include gun slide channel 116 for receiving gun slide 200 and a plurality of clamps 118 for securing gun slide in gun slide channel, as further illustrated in FIGS. 5 and 10-12.

Figure 2:
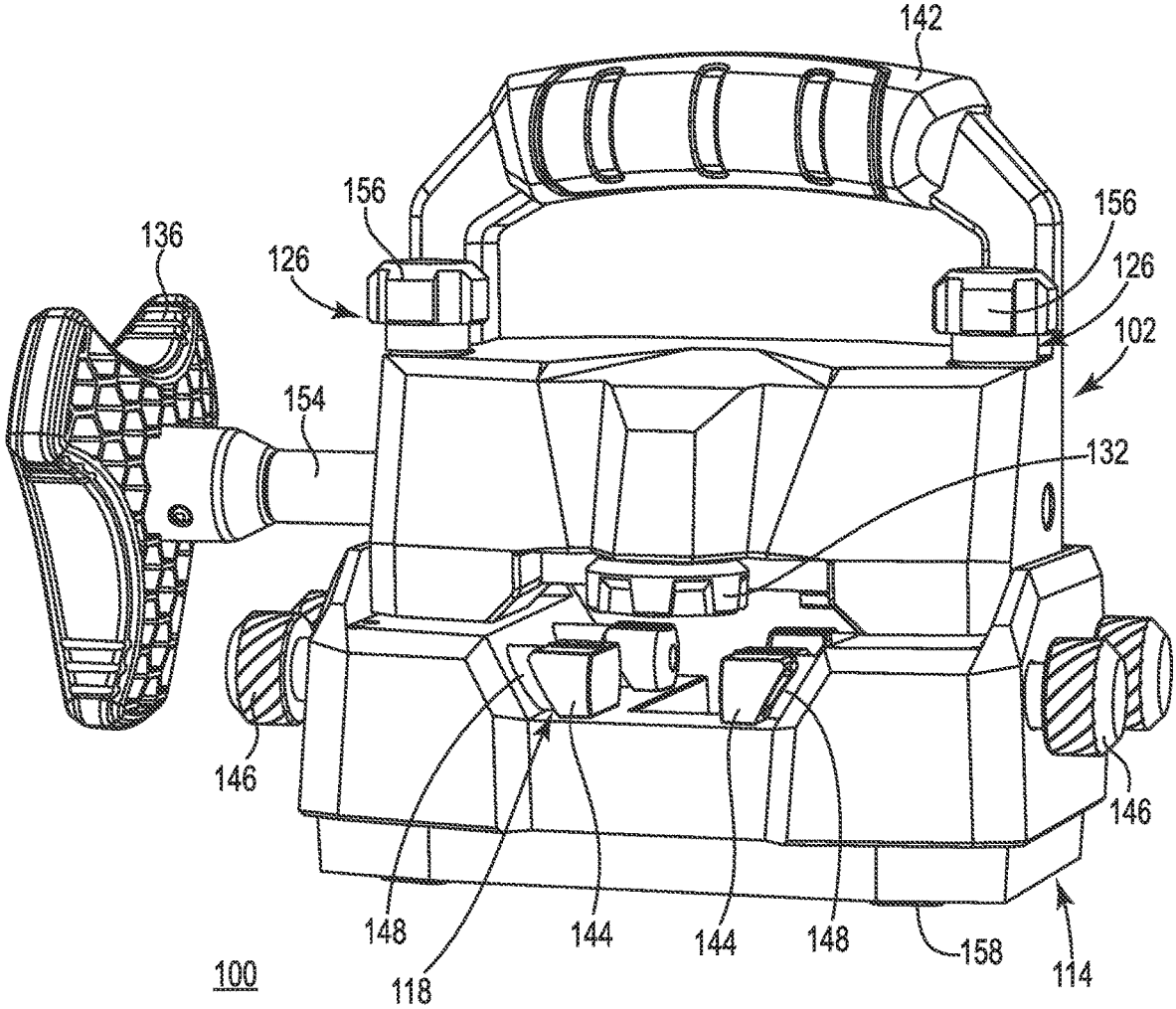
FIG. 2 is a back perspective view of the handgun sight pusher of FIG. 1.
Figure 6:
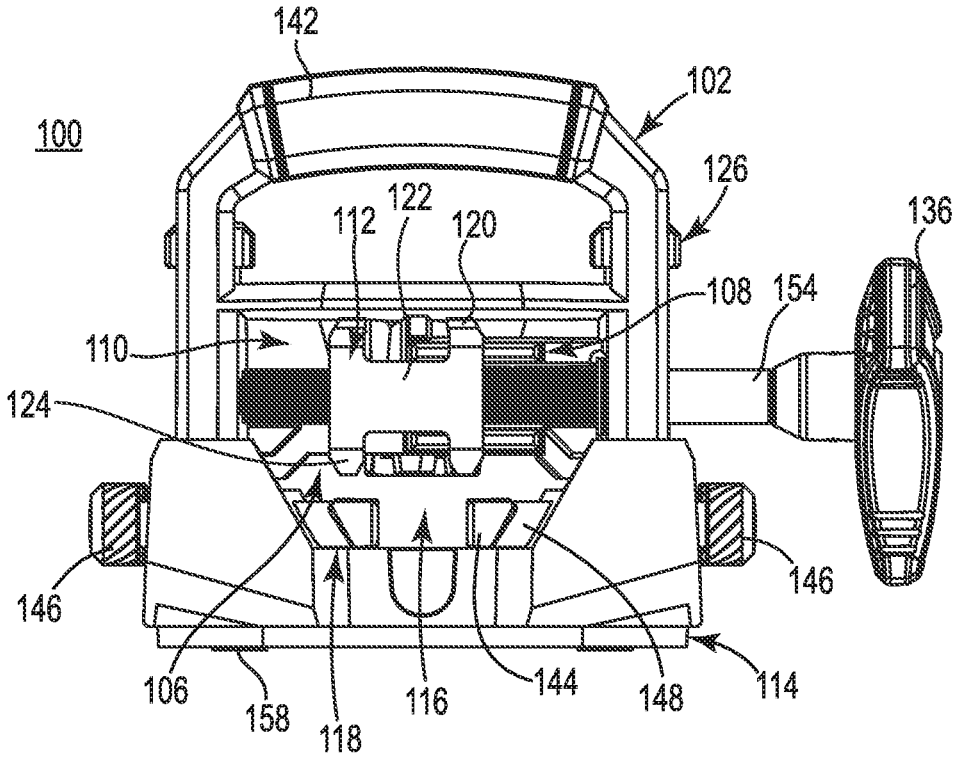
FIG. 6 is a front elevational view of the handgun sight pusher of FIG. 1 with the pusher block straddling the transitory space and the rotation space.
Figure 7:
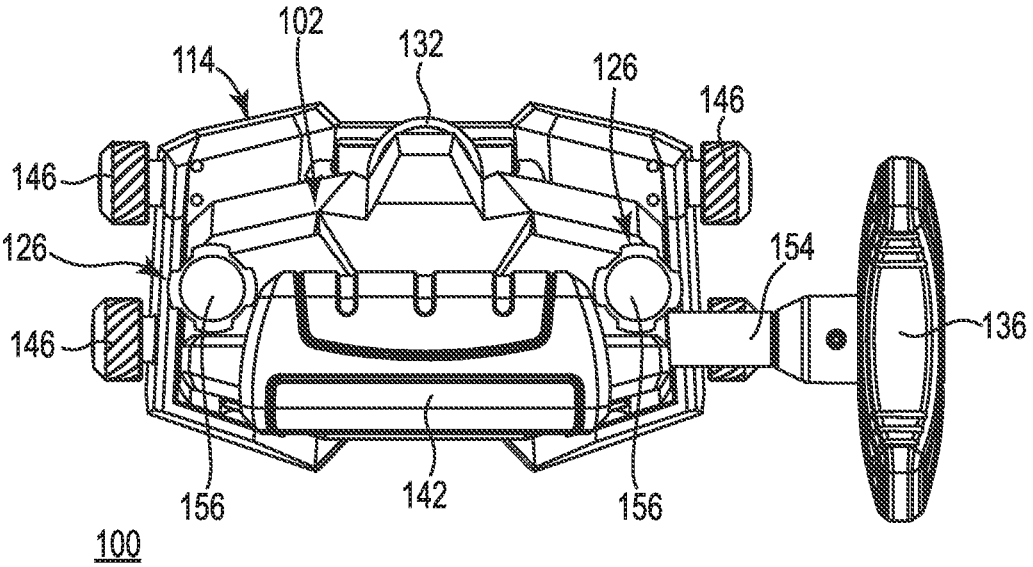
FIG. 7 is a top plan view of the handgun sight pusher of FIG. 1.
Figure 8:
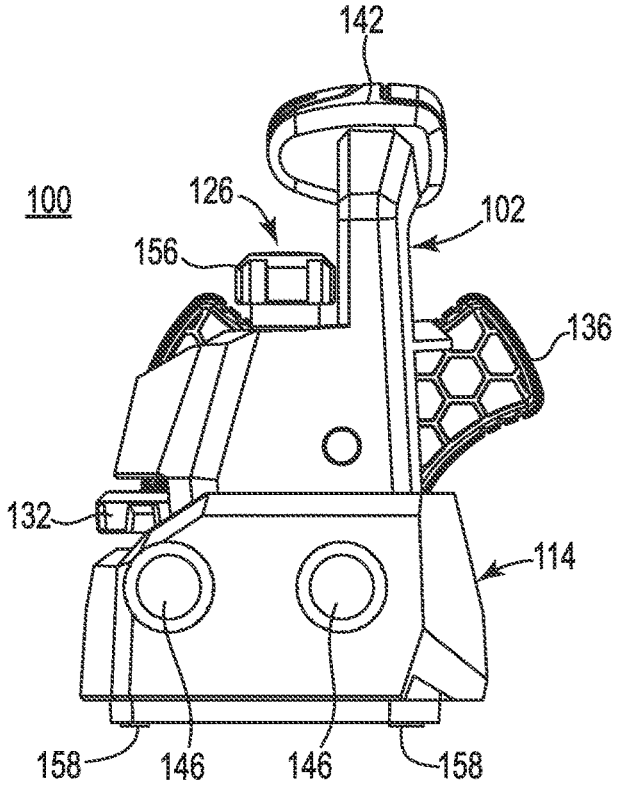
FIG. 8 is a right side view of the handgun sight pusher of FIG. 1.
Figure 9:
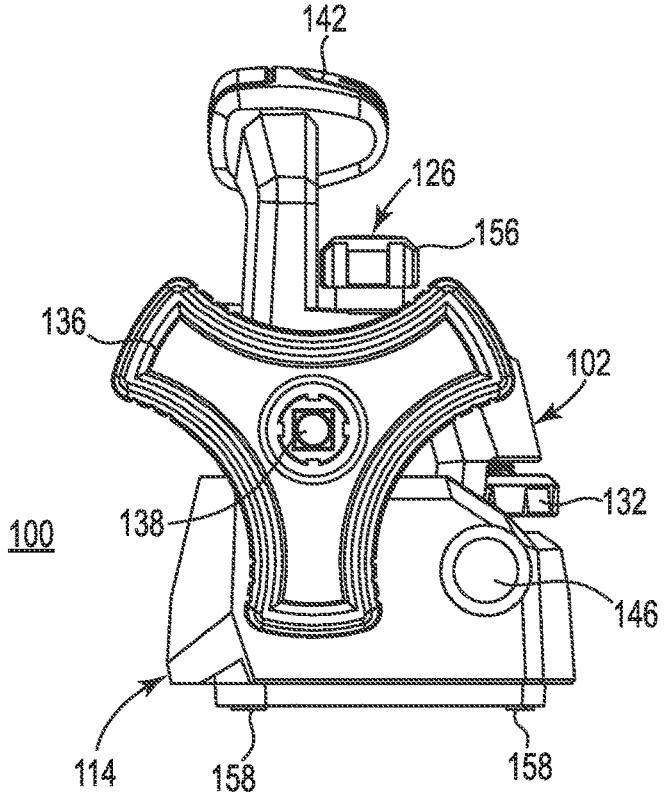
FIG. 9 is a left side view of the handgun sight pusher of FIG. 1.
Figure 10:
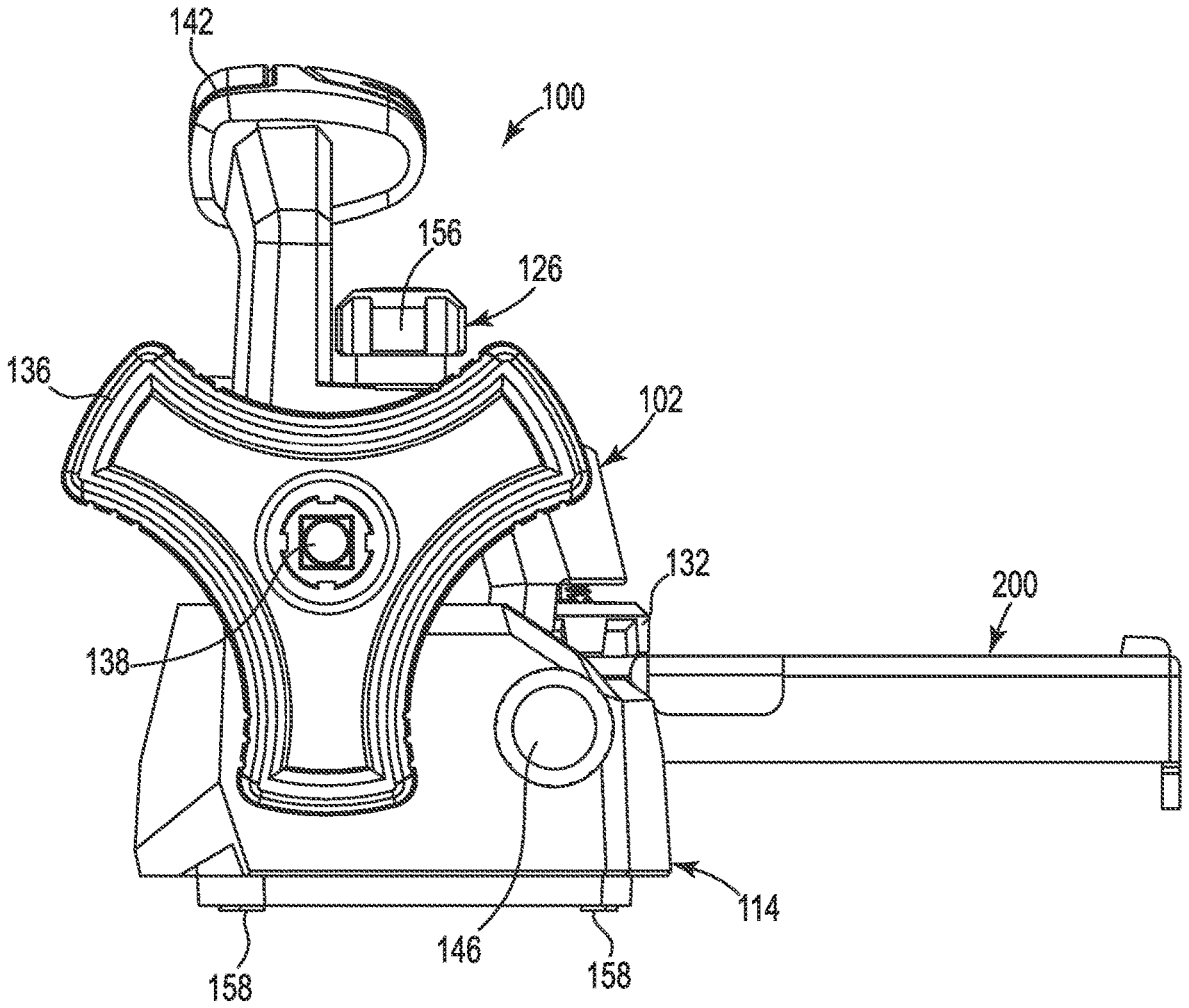
FIG. 10 is a left side view of the handgun sight pusher of FIG. 1 engaged with a gun slide.
Figure 11:
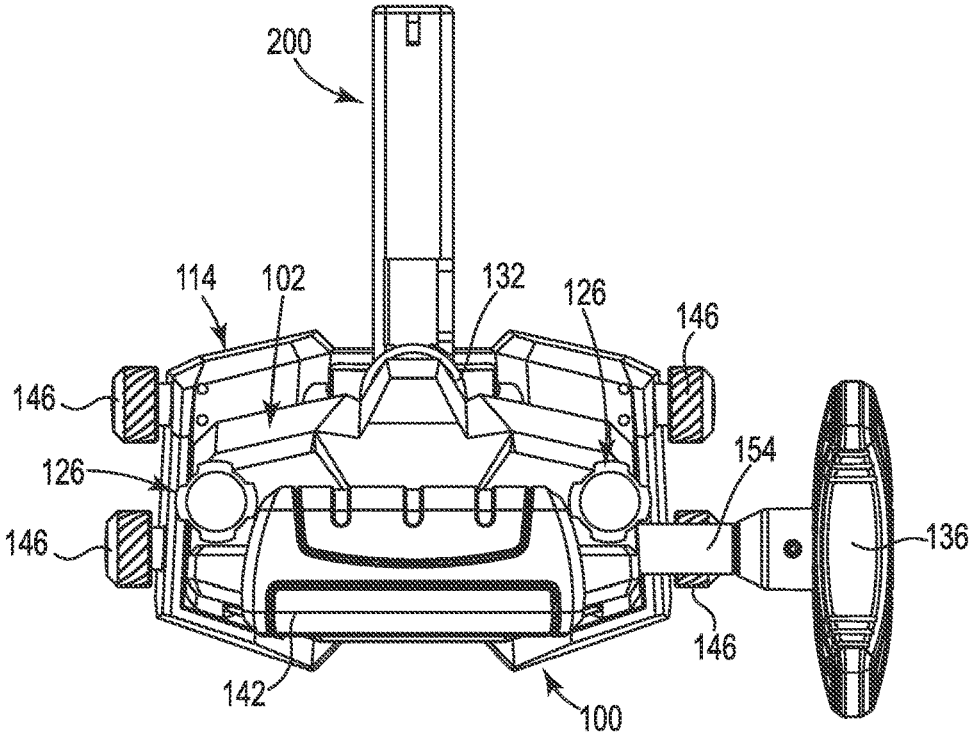
FIG. 11 is a top plan view of the handgun sight pusher of FIG. 1 engaged with a gun slide.
Figure 12:
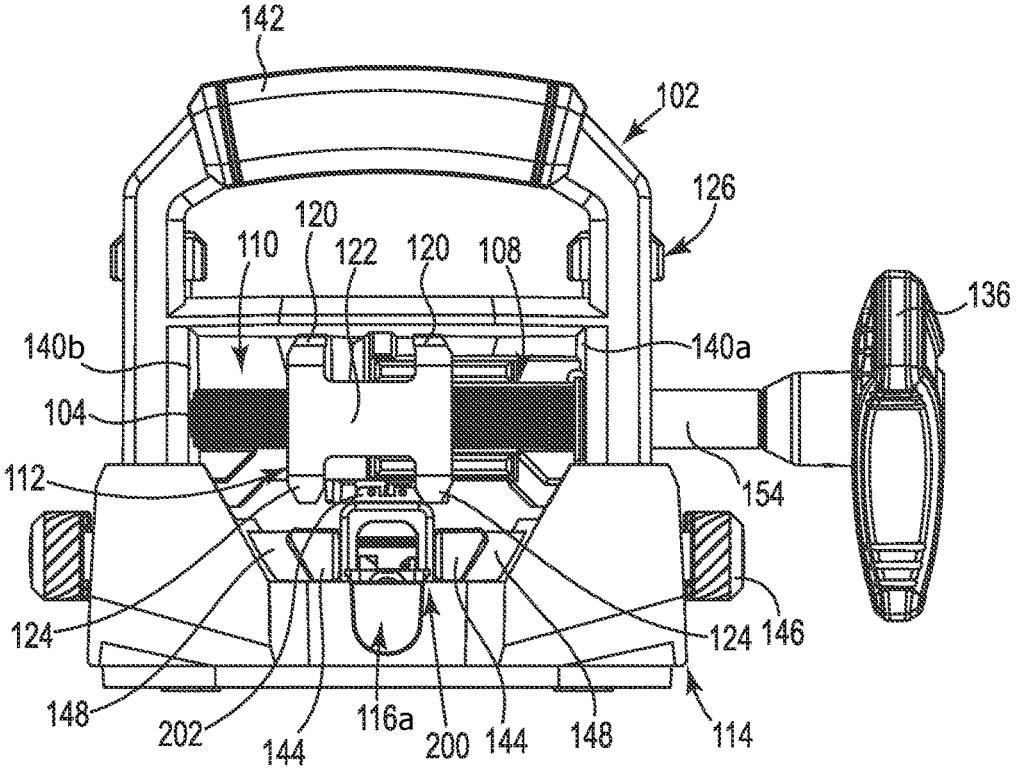
FIG. 12 is a front elevational view of the handgun sight pusher of FIG. 1 engaged with a gun slide.

Additional views of handgun sight pusher 100 are provided. FIG. 2 is a back perspective view of the handgun sight pusher. FIG. 3 is a perspective view of the handgun sight pusher with a pusher block in a transitory space of an internal adjustment cavity. FIG. 4 is a perspective view of the handgun sight pusher with the pusher block in a rotation space of the internal adjustment cavity. FIG. 5 is an exploded view of the handgun sight pusher. FIG. 6 is a front elevational view of the handgun sight pusher with the pusher block straddling the transitory space and the rotation space. FIG. 7 is a top plan view of the handgun sight pusher. FIG. 8 is a right side view of the handgun sight pusher. FIG. 9 is a left side view of the handgun sight pusher. FIG. 10 is a left side view of the handgun sight pusher engaged with a gun slide. FIG. 11 is a top plan view of the handgun sight pusher engaged with a gun slide. FIG. 12 is a front elevational view of the handgun sight pusher engaged with a gun slide.

Handgun sight pusher 100 can generally be comprised of rigid materials such that handgun sight pusher cannot be folded, bent, or otherwise forced out of shape. Examples of materials used for handgun sight pusher 100 include, but are not limited to, metal (for example, aluminum, steel, iron, brass, copper, etc.), plastic (for example, high-density polyethylene, polyvinyl chloride, polypropylene, other thermoplastic polymers, etc.), high durometer rubber, and combinations thereof.

Upper frame 102 of handgun sight pusher 100 can include screw drive 104 within internal adjustment cavity 106. Screw drive 104 can be a threaded rod positioned horizontally within internal adjustment cavity 106 such that it spans between left side wall 140*a* and right side wall 140*b* of upper frame 102. As described in more detail below, screw drive 104 can be rotatably engaged with pusher block 112. More specifically, pusher block 112 can include a threaded bore that spans from a first side of pusher block through a second side. In this manner, screw drive 104 can be located in the threaded bore and, when screw drive is rotated, pusher block 112 can move along the threads of screw drive such that it translates from left to right and vice versa.

Internal adjustment cavity 106 can be located within an approximately rectangular external housing that has an open front face and bottom face, as illustrated in FIG. 5. Also located within internal adjustment cavity 106 can be transitory space 108 on a first side of internal adjustment cavity and rotation space 110 on a second side of internal adjustment cavity. Transitory space 108 can be defined by a first internal back face of the rectangular housing and one of the two internal side walls (for example, left side wall 140*b*). Rotation space 110 can be defined by a second internal back face of the rectangular housing and the other of the two internal side walls (for example, right side wall 140*a*). The first internal back face that defines transitory space 108 can be closer to the open front face of the rectangular housing than the second internal back face that defines rotation space 110. Therefore, rotation space 110 can have a larger depth value (measured from open front face to second internal back face) compared to the depth value of transitory space 108 (measured from open front face to first internal back face).

Pusher block 112, which can be rotatably engaged with screw drive 104, can have at least two pusher flanges 120 on a top of pusher block that are separated by bridge 122, as illustrated in FIG. 5. In some embodiments, pusher block 112 can also have two pusher flanges 124 on a bottom of pusher block that are separated by bridge 122, as also illustrated in FIG. 5. Pusher flanges 120, 124 can each have a height (defined as the distance between the center of screw drive 104 and a top of pusher flange 120, 124) that is greater than the distance between the first internal back face and the center of screw drive 104. Further, the height of pusher flanges 120, 124 can be less than the distance between the second internal back face and screw drive 104. Therefore, pusher block 112 is limited from rotating around a first axis parallel to screw drive 104 when at least a portion of pusher block is located in transitory space 108 (i.e., pusher block retains its orientation in the transitory space), as illustrated in FIG. 3, but is free to rotate around the first axis when at least most, if not all, of pusher block is located within rotation space 110, as illustrated in FIG. 4.

Pusher flanges 120 and 124 can be located opposite each other on pusher block 112. In some embodiments, pusher block 112 can include at least two each of pusher flanges 120, 124 and, as illustrated in FIGS. 3-4, bridge 122 of pusher block 112 can span the distance between pusher flanges 120 and 124. One of the two pusher flanges 120 can be located at the edge of pusher block 112 nearest one of the internal side walls (for example, left side wall 140*a*), and the other of the two pusher flanges 120 can be located opposite the first and at the edge of pusher block nearest the other of the internal side walls (for example, right side wall 140*b*), as illustrated in FIGS. 6 and 12.

When looking at pusher flanges 120 from the side, each pusher flange can appear generally triangular in shape with its top point extended further upward, the top point then being roughly rectangular in shape, as illustrated in FIG. 3. In some embodiments, an outer face of the upper point of each pusher flange 120 (i.e., the faces directly facing internal side walls 140*a/b*) can be sloped inward toward the center of pusher flange while the inner face of each pusher flange can be relatively straight, as illustrated in FIG. 12. Therefore, when looking at pusher flange 120 from the front or back of handgun sight pusher 100, the part of pusher flange that connects to bridge 122 may appear wider than the top.

Similar to pusher flanges 120, one of the two pusher flanges 124 can be located at the edge of pusher block 112 nearest one of the internal side walls (for example, left side wall 140*a*), and the other of the two pusher flanges 120 can be located opposite the first and at the edge of pusher block nearest the other of the internal side walls (for example, right side wall 140*b*). In this way, pusher flanges 120 and 124 appear opposite each other, as illustrated in FIG. 3. In some embodiments, pusher flanges 124 can have a similar general shape as pusher flanges 120 in that they also extend away from bridge 122 and have front and back edges that slope inward, but they can be slightly different in that have a more rounded shape.

More specifically, when looking at pusher flanges 124 from the side, pusher flanges can appear generally semi-circular in shape with a flat top, as illustrated in FIG. 3. In some embodiments, both the outer and inner faces can be sloped inward toward the center of their respective pusher flange 124. Therefore, when looking at pusher flange 124 from the front or back of handgun sight pusher 100, the part of pusher flange that connects to bridge 122 may appear wider than the outermost point, giving pusher flange a roughly triangular appearance with the outermost point appearing flat, as illustrated in FIG. 12.

In cases where pusher block 112 includes two each of pusher flanges 120, 124, bridge 122, as described above, can span between each set of the pusher flanges. As illustrated in FIGS. 6 and 12, each set of pusher flanges 120 and 124 can protrude out from bridge 122 and can be located near the outer edges of pusher block 112, thereby leaving open space within each set of the pusher flanges. This, in essence, gives pusher block 112 an approximate "H" shape. In use, when gun slide 200 is secured in handgun sight pusher 100, the inner and outer faces of pusher flanges 120, 124 can be the part of pusher block 112 that makes contact with the gun sight and is used to adjust or remove the gun sight.

As mentioned above, and illustrated in FIG. 1, in order to secure gun slide 200 in gun slide channel 116 for adjustment of the gun sight, handgun sight pusher 100 can include lower frame 114 connected to upper frame 102, and lower frame can include gun slide channel for receiving gun slide and a plurality of side clamps 118 for securing gun slide in gun slide channel, as illustrated in FIGS. 5 and 10-12.

Gun slide channel 116, as illustrated in FIG. 6, can be defined as an open space having an upper limit defined by the bottommost horizontal plane of pusher block 112, a lower limit defined by the solid material of lower frame 114, and right and left side limits defined by side clamps 118. Since upper frame 102 is vertically adjustable relative to lower frame 114, as described in more detail below, and side clamps 118 are horizontally adjustable, the open space defining gun slide channel 116 is variable and not fixed.

In some embodiments, gun slide channel 116 can have bottom channel gap 116*a* that can be surrounded by the solid material of lower frame 114 on four of its six planes, leaving a top plane and a front plane open, as illustrated in FIG. 5. Channel gap 116*a* is structured and configured to accommodate pistol slides that may have portions extending downward (for example, a 1911 pistol slide).

As mentioned above, to secure gun slide 200 in lower frame 114 once it is placed within gun slide channel 116, side clamps 118 can be moved inward toward gun slide until they make contact with, and push against, gun slide, thereby horizontally securing gun slide in place using pressure means. To further secure gun slide 200 and prevent unwanted movement, upper frame 102 may also include vertical hold down 132, as illustrated in FIGS. 10-11 and described in more detail further below.

More specifically, to secure gun slide 200 in gun slide channel 116 of lower frame 114 so that gun's sight can be adjusted by pusher block 112, a plurality of side clamps 118 can be located on either side of gun slide channel, as illustrated in FIGS. 1-2 and 6, and can be in horizontal alignment with each other to apply even pressure on gun slide. Therefore, when gun slide 200 is placed in gun slide channel 116, side clamps 118 can be moved inward, toward gun slide channel, until they come in contact with gun slide, as illustrated in FIG. 12, and secure gun slide in place using pressure. By securing gun slide 200 in place, unwanted movement by gun slide can be minimized when pressure is placed on the sight of gun slide 200.

In some embodiments, handgun sight pusher 100 can include four side clamps 118 housed in lower frame 114 through horizontal bores 152, as illustrated in FIGS. 1-2 and 5. However, any even number of side clamps 118 and horizontal bores 152 can be used, such as two, six, eight, etc. In embodiments having four side clamps 118 and four horizontal bores 152, a first set of two of the four side clamps and horizontal bores can be located on a right side of lower frame 114, and a second set of the other two of the four side clamps and horizontal bores can be located on a left side of lower frame. Each set of side clamps 118 can be located in the same vertical plane, such that each set of side clamps and horizontal bores 152 can be horizontally in line with each other (i.e., each set includes a front and a back side clamp and bore), as illustrated in FIG. 2. Therefore, the plurality of side clamps 118 and horizontal bores 152 can include a front, right side clamp and bore; a back, right side clamp and bore; a front, left side clamp and bore; and a back, left side clamp and bore, as illustrated in FIG. 5.

As mentioned above, in addition to each set of side clamps 118 and horizontal bores 152 being located in the same vertical plane, the two sets of side clamps and horizontal bores can also mirror each other in order to apply even pressure on gun slide 200. More specifically, the two front side clamps 118 and horizontal bores 152 (and, likewise, the two back side clamps and horizontal bores) can be mirror images of each other such that if the two front side clamps (and, likewise, the two back side clamps) were both moved inward toward gun slide channel 116, they would eventually meet each other and touch. In this manner, each of the side clamps 118 mirrors a first side clamp behind (or in front) of it and a second side clamp across gun slide channel 116 from it. Likewise, each of the horizontal bores 152 mirrors a first horizontal bore behind (or in front) of it and a second horizontal bore across gun slide channel 116 from it.

It is envisioned that side clamps 118 move along a horizontal axis, through horizontal bores 152, toward and away from gun slide channel 116. To accomplish this movement, in one embodiment, side clamps 118 can freely slide in and out through horizontal bores 152 and have a locking mechanism that secures them in their desired configuration, such as a cam lever. Alternatively, in another embodiment, portions of side clamps 118 can be threadedly engaged with each other such that rotation of each side clamp in a first direction moves it through horizontal bore 152 and toward gun slide channel 116, and rotation of each side clamp in a second direction through horizontal bore moves it away from gun slide channel. In yet another embodiment, instead of being threadedly engaged with each other, side clamps 118 can be threadedly engaged with lower frame 114 and can move in a similar manner (i.e., rotation one direction moves them toward gun slide channel 116 and rotation in a second direction moves them away from gun slide channel).

If threadedly engaged with each other, as illustrated herein, each side clamp 118 can include side clamp plate 144, side clamp knob 146, side clamp rod 148, and side clamp shaft 150. Side clamp plate 144 can be on an inner end of side clamp 118 and can protrude into gun slide channel 116, as illustrated in FIGS. 1-2. More specifically, side clamp plate 144 can be a cap on an inner end of side clamp rod 148, as illustrated in FIG. 5, or it can be a flat end portion of side clamp rod 148 such that side clamp plate and side clamp rod are one continuous piece. In use, side clamp plate 144 makes contact with gun slide 200 and, therefore, can be made from materials that will not mark, dent, or mar gun slide. For example, side clamp plate 144 can be made from an engineering resin that can robustly resist breakage or deformation while not marking, denting, or marring gun slide 200. Further, side clamp plate 144 may have a flat or mostly flat face so as to apply even pressure along its face to gun slide 200.

Side clamp knob 146 can be on an outer end of side clamp 118 and can protrude out from the outer side edge of lower frame 114, as illustrated in FIGS. 1-2. More specifically, side clamp knob 146 can be a knob or attachment that is structured and configured to increase gripping ability of a user by having a high friction coefficient compared to smooth metals or plastics, and it can be located on an end portion of side clamp shaft 150, as illustrated in FIG. 5. Alternatively, side clamp knob 146 can be an end portion of side clamp shaft 150 such that side clamp knob and side clamp shaft are one continuous piece.

In some embodiments, side clamp knob 146 can be roughly cylindrical having a curved outer circumference, a flat or mostly flat surface on an outside face of its outer circumference, and a connection point on an inside face of its circumference to attach to side clamp shaft 150. The outer circumference can, in some cases, be textured, such as knurled, ribbed, ridged, or otherwise texturally patterned, so as to increase friction with a user's fingers when a user is twisting side clamp knob 146. Alternatively, the outer circumference can, instead of having a textured surface, be made of a material that has an increased friction coefficient, such as a natural or synthetic rubber or similar material.

As mentioned above, portions of side clamps 118 can be threadedly engaged with each other. More specifically, side clamp rod 148 and side clamp shaft 150 can be threadedly engaged with each other such that when side clamp knob 146 is rotated, it can also rotate side clamp shaft and cause side clamp rod 148 to move toward or away from side clamp knob depending on which direction side clamp knob is rotated. To ensure side clamp rod 148 is the component that moves instead of side clamp shaft 150, each side clamp shaft can be fixed in place within horizontal bores 152. Further, side clamp shaft 150 can be externally threaded while side clamp rod 150 is internally threaded and has a smooth outer surface. Therefore, when side clamp shaft 150 rotates, the threaded connection between side clamp shaft and side clamp rod 148 causes side clamp rod to be effectively either pulled into horizontal bore 152 toward side clamp knob 146 or pushed out from horizontal bore toward gun slide channel 116.

To assist side clamps 118 with securing gun slide 200 in handgun sight pusher 100, handgun sight pusher can include vertical hold down 132, which can clamp gun slide in gun slide channel 116 between vertical hold down and lower frame 114, thereby vertically securing gun slide in place using pressure means, as illustrated in FIG. 10. Vertical hold down 132 can protrude from a bottom edge of upper frame 102, as illustrated in FIG. 2, and can, similar to side clamp plates 144, be movable so as to, first, provide space for gun slide 200 to be positioned in gun slide channel 116 and, second, adjustably secure a gun slide in place regardless of differences in sizes or dimensions of various gun slides.

More specifically, similar to side clamp plates 144, vertical hold down 132 can be a cap or flat knob on an end of an adjustable rod, or it can be a flat end portion of the adjustable rod such that vertical hold down and the adjustable rod are one continuous piece. For example, vertical hold down 132 may be a cylindrical knob attached to an end of a threaded rod, as illustrated in FIG. 10. Therefore, when vertical hold down 132 is rotated, it can cause the threaded rod to move into or out of a threaded bore in upper frame 102. As such, rotating vertical hold down 132 in a first direction can cause it to move upwards relative to a flat surface on which handgun sight pusher 100 is placed, creating additional space for gun slide 200 to be inserted into gun slide channel 116. Further, rotating vertical hold down 132 in a second direction can cause it to move downwards, decreasing space for gun slide 200 and, eventually, making contact with the top of gun slide and securing gun slide in place.

Since vertical hold down 132 makes contact with gun slide 200 in use, it can, therefore, can be made from materials that will not mark, dent, or mar gun slide. For example, vertical hold down 132 can be made from an engineering resin that can robustly resist breakage or deformation while not marking, denting, or marring gun slide 200. Further, vertical hold down 132 may have a flat or mostly flat bottom face so as to apply even pressure along its face to gun slide 200. In some cases, since only the bottom face of vertical hold down 132 makes contact with gun slide 200, only the bottom face of vertical hold down may be made of a non-damaging material or, alternatively, an additional, non-damaging material may be placed on top of the bottom face, which itself can then be made of any rigid material.

In some embodiments, to enable a user to more easily twist vertical hold down 132, the curved, outer circumference of vertical hold down may, similar to side clamp knob 146, have a textured surface (for example, a knurled, ribbed, ridged, or otherwise texturally patterned), be made of a material that has a high friction coefficient compared to smooth metals or plastics (for example, a natural or synthetic rubber or similar material), and/or can have raised and sunken portions that are larger and more spread out than those envisioned in a standard, textured surface. As illustrated in FIG. 2, the raised and sunken portions can be wide peaks and valleys that alternate around the circumference of vertical hold down 132. This pattern can allow portions of a user's fingers, such as the tips, to sink into the valleys and wedge up against the edges of the peaks, thereby allowing for increased gripping capacity on vertical hold down 132. This increased gripping capacity can enable a user to apply more force with vertical down 132 against gun slide 200 than might otherwise be available, in turn allowing for additional force to be applied against the gun sight by sight pusher 112 before gun slide begins to have unwanted movement.

While side clamps 118 and vertical hold down 132 are used to secure gun slide 200 in place within gun slide channel 116, they primarily concern making smaller adjustments once upper frame 102 and lower frame 114 are largely in place. The larger adjustments needed to get upper frame 102 and lower frame 114 in place can be made by allowing upper frame and lower frame to be adjustable relative to each other. Therefore, upper frame 102 and lower frame 114 are envisioned as separate pieces that are otherwise connected together.

More specifically, to connect lower frame 114 to upper frame 102, frame bolts 126 can be used that can be inserted through vertical bores 128, which are aligned to translate from upper frame into lower frame, as illustrated in FIG. 5. Additionally, springs 130 may be housed in vertical bores 128 and around frame bolts 126 to aide in keeping vertical tension on upper frame 102 so that it resists gravitational pulls downward. Therefore, springs 130 resist their compression and work to push upper frame 102 and lower frame 114 away from each other.

In some embodiments, handgun sight pusher 100 can include two vertical bores 128 that penetrate both upper frame 102 and lower frame 114, one on each of a right and left side of handgun sight pusher so that they are positioned to flank gun slide channel 116, as illustrated in FIG. 5. Each vertical bore 128 can be paired with a frame bolt 126 and a spring 130 such that the frame bolt can be inserted into a top of upper frame 102 through vertical bore, can translate entirely through upper frame and out the bottom of upper frame, can insert through spring, and can insert into vertical bore of lower frame 114.

Part or all of frame bolts 126 and vertical bores 128 can be threaded to enable frame bolts to threadedly connect with vertical bores, thereby keeping upper frame 102 and lower frame 114 securely connected to each other. For example, an exterior of frame bolts 126 may be threaded, and an interior of vertical bores 128 may be threaded to correspond with the threading on frame bolts. The threaded portion of vertical bores 128 may be solely in upper frame 102, solely in lower frame 114, or may be in both upper and lower frames.

In some embodiments, and as illustrated in FIG. 2, each frame bolt 126 may also include frame bolt knob 156, which can be a cap or knob on an upper end of frame bolt relative to a flat surface on which handgun sight pusher 100 is placed, as illustrated in FIGS. 7-9. Alternatively, frame bolt knob 156 can be an enlarged end portion of frame bolt 126 such that frame bolt knob and frame bolt are one continuous piece. In either case, when frame bolt knob 156 is rotated, it can cause frame bolt 126 to move into or out of vertical bore 128 in upper frame 102. As such, rotating frame bolt knob 156 in a first direction can cause it to move upwards relative to a flat surface on which handgun sight pusher 100 is placed. Further, rotating frame bolt knob 156 in a second direction can cause it to move downwards.

Therefore, in embodiments with two or more frame bolts 126, the coordinated movement up or down of frame bolts can cause upper frame 102 to correspondingly move up or down, thereby providing more or less space in gun slide channel 116. For example, to create more space in gun slide channel 116, all frame bolt knobs 156 may be rotated in a first direction (for example, counterclockwise), which causes upper frame 102 to move upwards. Once gun slide 200 is placed in gun slide channel 116, all frame bolt knobs 156 may then be rotated in a second direction (for example, clockwise), which causes upper frame 102 to move downwards toward gun slide. This adjustability can allow users to align pusher flanges 120 or 124 with the sight of gun slide 200 so that when pusher block 112 is moved along screw drive 104, it properly makes contact with, and pushes against, the gun sight to either remove or adjust the gun sight. Further, the ability of side clamps 118 and vertical hold down 132 to independently adjust so as to secure gun slide 200 enables movement of upper frame 102 and lower frame 114 to be focused on aligning pusher block 112 with the gun sight.

When adjusting upper frame 102 and lower frame 114, or during other operational use, user can grip onto handle 142, which can be located at the top of upper frame, such that it is the uppermost feature of handgun sight pusher 100 when handgun sight pusher is standing upright. Handle 142 can be one solid piece, or it can incorporate a cover 162, as illustrated in FIG. 5. Handle cover 162 can be comprised of one, two, or more pieces that surround a center frame of handle 142. For example, as illustrated in FIG. 5, handle cover 162 may be comprised of two pieces that come together on a front and a back of handle 142 to provide an ergonomic gripping point for the user. Therefore, the material used for handle cover 162 can be a flexible material such as silicone or a thermoplastic elastomer. However, this is not necessary and other, more rigid, materials may instead be used.

In addition to handle 142, handgun sight pusher 100 may include feet 158 on a bottom surface of lower frame 114, as illustrated in FIG. 5. Feet 158 can be manufactured from a natural or synthetic rubber or similar material that has useful properties, such as tackiness, that allows for high friction between feet and a smooth surface, such as a table or workbench upon which handgun sight pusher may be placed. In this way, feet 158 may help prevent handgun sight pusher 100 from sliding on a surface and may also help protect the surface from any marking, denting, or marring that may be caused by handgun sight pusher.

When upper frame 102 and lower frame 114 are in place such that a bottom of pusher block 112 is properly vertically aligned with gun slide, and when gun slide 200 is fixed between side clamps 118 and, optionally, vertical hold down 132, pusher block can be translated along screw drive 104 until it makes contact with the sight of gun slide and can, therefore, adjust the gun sight accordingly.

To easily enable rotation of screw drive 104, the left and/or right side walls 140*a/b* of upper frame 102 can include at least one horizontal bore 134 through which screw drive penetrates, and screw drive can protrude out from horizontal bore, as illustrated in FIGS. 1 and 3-4. In some embodiments, screw drive 104 may include outer arm 154, as illustrated in FIGS. 5-6 and 12, and screw drive may be structured and configured such that the threaded portion of screw drive 104 is retained within internal adjustment cavity 106 while outer arm 154 extends outward from upper frame 104.

In some embodiments, an exterior end of screw drive 104 or, alternatively, outer arm 154 of screw drive, can be attached to hand crank 136, which can be used to rotate screw drive around the first axis that is parallel to, and centered on, screw drive. Hand crank 136 can be an ergonomic gripping point having a plurality of fingers that extend out from a central core, as illustrated in FIGS. 1-5. For example, hand crank 136 can have three fingers that are spaced equidistant apart from each other. This spacing and configuration can enable a user to have a comfortable, firm grip on hand crank 136 when, for example, the user is rotating hand crank so as to move pusher block 112 along screw drive 104 and to use pusher block to move the sight on gun slide 200. Since sights are known to be firmly positioned and sometimes stuck on their gun slides, having the ability to comfortably apply torque to use pusher block 112 to force the gun sight to move is a benefit to the user.

In some cases, hand crank 136 can include socket drive 138. Socket drive 138 can be centered on the core of hand crank 136 and can be used to increase the rotational speed of hand crank during operation. Alternatively, socket drive 138 can add assistance for users who have limited hand strength by connecting with a tool that is easier for those users to rotate.

Persons of ordinary skill in arts relevant to this disclosure and subject matter hereof will recognize that embodiments may comprise fewer features than illustrated in any individual embodiment described by example or otherwise contemplated herein. Embodiments described herein are not meant to be an exhaustive presentation of ways in which various features may be combined and/or arranged. Accordingly, the embodiments are not mutually exclusive combinations of features; rather, embodiments can comprise a combination of different individual features selected from different individual embodiments, as understood by persons of ordinary skill in the relevant arts. Moreover, elements described with respect to one embodiment can be implemented in other embodiments even when not described in such embodiments unless otherwise noted. Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended. Furthermore, it is intended also to include features of a claim in any other independent claim even if this claim is not directly made dependent to the independent claim.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of Section 112, sixth paragraph of 35 U.S.C. are not to be invoked unless the specific terms "means for" or "step for" are recited in a claim.

What is claimed is:

1. A handgun sight pusher comprising:

an upper frame having a screw drive within an internal adjustment cavity and a pusher block rotatably engaged with the screw drive, wherein the internal adjustment cavity includes a transitory space and a rotation space; and a lower frame connected to the upper frame and having a gun slide channel for receiving a gun slide and a plurality of side clamps for securing the gun slide in the gun slide channel, wherein rotation of the screw drive causes the pusher block to move along the screw drive, wherein movement of the pusher block along the screw drive transitions the pusher block between the transitory space and the rotation space, and wherein the internal adjustment cavity is structured and configured such that the pusher block retains its orientation in the transitory space and rotates freely within the rotation space.

2. The handgun sight pusher of claim 1, wherein the pusher block includes at least two pusher flanges on a top of the pusher block that are separated by a bridge.

3. The handgun sight pusher of claim 2, wherein the pusher block includes at least two pusher flanges on a bottom of the pusher block that are separated by the bridge.

4. The handgun sight pusher of claim 1, wherein at least one each of the plurality of side clamps are located on either side of the gun slide channel and are in horizontal alignment with each other.

5. The handgun sight pusher of claim 1, wherein the gun slide channel includes a bottom channel gap.

6. The handgun sight pusher of claim 1, the upper frame further including a vertical hold down for clamping the gun slide between the vertical hold down and the gun slide channel of the lower frame.

7. The handgun sight pusher of claim 1, wherein the lower frame connects to the upper frame by frame bolts positioned to flank the gun slide channel.

8. The handgun sight pusher of claim 7, wherein the upper frame and the lower frame have aligned vertical bores through which the frame bolts penetrate, and further wherein the frame bolts are threadedly connected to the threaded vertical bores of the lower frame.

9. The handgun sight pusher of claim 8, wherein the vertical bores each additionally house a spring.

10. The handgun sight pusher of claim 1, wherein the upper frame includes at least one horizontal bore through which the screw drive penetrates, and further wherein the screw drive protrudes out horizontally from the upper frame and through the horizontal bore.

11. The handgun sight pusher of claim 10, wherein an exterior end of the screw drive is attached to a hand crank that is used to rotate the screw drive.

12. The handgun sight pusher of claim 11, wherein the screw drive, the pusher block, and the hand crank all rotate around a first axis.

13. The handgun sight pusher of claim 11, wherein the hand crank includes a socket drive.

14. A handgun sight pusher comprising:

an upper frame having a screw drive within an internal adjustment cavity and a pusher block rotatably engaged with the screw drive, wherein the internal adjustment cavity includes a transitory space and a rotation space; and a lower frame connected to the upper frame and having a gun slide channel for receiving a gun slide and a plurality of side clamps for securing the gun slide in the gun slide channel, wherein:

rotation of the screw drive causes the pusher block to move along the screw drive, movement of the pusher block along the screw drive transitions the pusher block between the transitory space and the rotation space, the pusher block retains its orientation in the transitory space and rotates freely within the rotation space, and the pusher block includes at least two pusher flanges on a top of the pusher block that are separated by a bridge.

15. A method of adjusting a handgun sight of a gun slide, the method comprising:

rotating a screw drive in a first direction until a pusher block that is rotatably engaged with the screw drive moves from a transitory space into a rotation space;

rotating the screw drive in the first direction until the pusher block freely rotates 180 degrees in the rotation space;

rotating the screw drive in a second, opposite direction until the pusher block that is rotatably engaged with the screw drive moves from the rotation space to the transitory space such that the pusher block is now 180 degrees rotated from its starting position;

rotating the screw drive in the first or the second direction until the pusher block makes contact with a sight of a gun slide; and continuing to rotate the screw drive until the sight is moved into a predetermined position.

16. The method of claim 15, the method further comprising:

positioning a gun slide in a gun slide channel; and securing the gun slide in the gun slide channel using a plurality of side clamps, wherein the sight is aligned with the pusher block when the gun slide is secured in the gun slide channel.

17. The method of claim 16, the method further comprising vertically securing the gun slide in the gun slide channel using a vertical hold down to clamp the gun slide between the vertical hold down and the lower frame.

18. The method of claim 14, wherein the pusher block includes at least two pusher flanges on a bottom of the pusher block that are separated by the bridge.

* * * * *